United States Patent [19]
Nemish
[11] 4,219,034
[45] Aug. 26, 1980

[54] DOUBLE SET HAIR STYLING ROLLER DEVICE

[76] Inventor: James Nemish, 419 Mar Lynn Ct., Escondido, Calif. 92025

[21] Appl. No.: 910,679

[22] Filed: May 30, 1978

Related U.S. Application Data

[63] Continuation-in-part of Ser. No. 807,784, Jun. 20, 1977, abandoned.

[51] Int. Cl.[2] ..... A45D 24/36
[52] U.S. Cl. ..... 132/40
[58] Field of Search ..... 132/40, 39, 41, 42, 132/33 R

[56] References Cited

U.S. PATENT DOCUMENTS

| | | | |
|---|---|---|---|
| 2,787,276 | 4/1957 | Loucks | 132/42 R |
| 3,455,309 | 7/1969 | Koss | 132/33 R |
| 3,682,182 | 8/1972 | Small | 132/40 |
| 3,870,057 | 3/1975 | Pezzino | 132/39 |
| 3,943,946 | 3/1976 | Gallegos | 132/39 |

FOREIGN PATENT DOCUMENTS

| | | | |
|---|---|---|---|
| 994202 | 7/1971 | Canada | 132/40 |
| 2000594 | 9/1969 | France | 132/40 |

*Primary Examiner*—G. E. McNeill
*Attorney, Agent, or Firm*—Seiler & Quirk

[57] ABSTRACT

A hair curling device combines a larger roller member comprising first and second crescent-shaped cylinder portions, each having a slot extending along their respective lengths and defined between two substantially parallel edges and along which the two cylinder portions are attached, the first cylinder portion having a greater diameter than the second cylinder portion, the second cylinder portion being secured interiorly of the first cylinder portion, whereby the second cylinder portion defines an elongated slot in which a second and relatively smaller roller is removably secured. The slot diameter is critically greater than the smaller roller diameter, and in a preferred embodiment, the slot is provided with a plurality of nipples or ribs for maintaining a spacial relationship between the smaller roller and slot surface.

4 Claims, 11 Drawing Figure

DOUBLE SET HAIR STYLING ROLLER DEVICE

REFERENCE TO OTHER APPLICATIONS

This application is a continuation-in-part of application Ser. No. 807,784 now abandoned, filed June 20, 1977.

BACKGROUND OF THE INVENTION

Rollers for curling the hair are well known. Normally, such rollers are single cylinders on which the hair is rolled and pinned until the hair has dried or some hair setting or conditioning composition has set or dried. Thereafter, the roller is removed and the hair brushed or combed as desired. Such rollers may be obtained having different diameters depending on the type of curls to be achieved by their use. Smaller diameter rollers naturally result in a tighter curl as compared to larger diameter rollers. For some hairdos, especially those involving high-style, where a tight curl is desired at or near the end of the hair away from the scalp, and a looser curl nearer the scalp, such single rollers are not generally suitable. Accordingly, double or combination rollers have been proposed, for example in U.S. Pat. Nos. 3,050,069 and 3,682,182. The earlier patented curlers are difficult to use, because with hair wrapped around the smaller roller, it cannot be readily fitted or placed within the larger of the rollers. Thus, the operator or user must be continually aware of, and careful not to wrap too much hair around the smaller roller, or the device will not function properly. Further, the full length of the larger roller cannot be used for rolling hair since the smaller roller is not as long. The later patent incorporates a smaller roller on which annular bands are secured at the end. Such a device is more difficult to manufacture, and the bands are somewhat fragile and may be easily broken unless care is taken during use and handling.

A more recent U.S. Pat. No. 3,870,057 discloses a roller assembly using an outside roller having a partially circular channel and an inside roller for fitting into the channel, wherein the channel has a diameter smaller than the diameter of the inside roller. If stiff materials are used in producing the components, the device is inoperable since the inside roller can not be held in the smaller diameter channel without one or the other components cracking or breaking. Yet, even with more flexible plastic materials, especially with the inside roller wrapped with hair, the constant expansion of the smaller diameter channel will cause fatigue and early failure of the device. Moreover, when the roller is wrapped with wet hair and forced inside the smaller diameter channel, the channel surface is spread to tightly press against the hair, resulting in a significant increase for hair drying time because of the greatly reduced air space. It is to the elimination of these disadvantages that the roller device of the present invention is directed.

BRIEF DESCRIPTION OF THE INVENTION

The hair curling device of the invention comprises a first relatively large diameter roller member having two elongated crescent-shaped cylinder portions secured together to form a slot extending along the length of the roller and in which slot, a second relatively smaller diameter roller is removably secured. The device is easy to use whereby the hair ends are rolled about a smaller diameter roller for a desired length and which is then snapped into the slot in the larger diameter slotted roller. Thereafter, the hair is further rolled on the slotted roller to the desired length. There are no fragile components to be broken nor is there difficulty in securing the smaller curler in the slot for the larger curler as in previous double roller devices. By the use of a smaller roller having a diameter less than the slot diameter, the smaller roller is held in place in the slot and there is provided sufficient space for hair rolled on the smaller roller. A preferred embodiment wherein the slot is provided with nipples or ribs for maintaining a space between the roller and slot surfaces allows for significant improvement in drying wet hair rolled on the assembly. These as well as other advantages will be evident from the following detailed description.

DETAILED DESCRIPTION OF THE INVENTION

Figure 1:
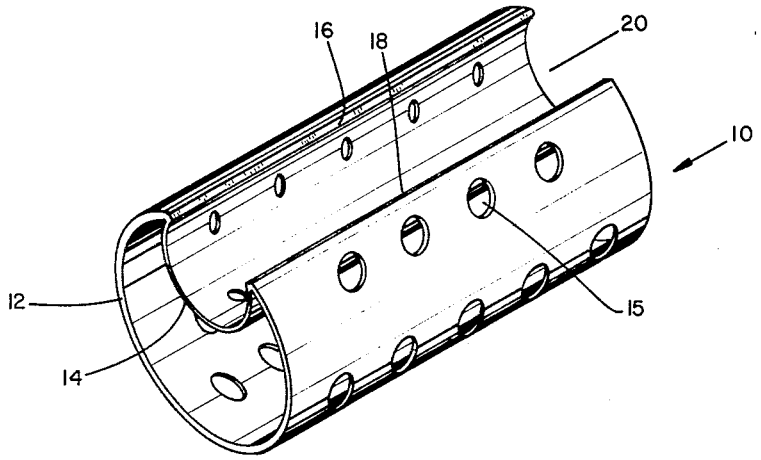
FIG. 1 is a perspective view of the relatively large diameter slotted hair roller of the invention.
Figure 2:
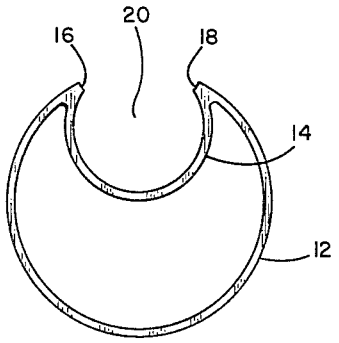
FIG. 2 is an end view of the roller of FIG. 1.

FIGS. 1 and 2 shows the relatively large diameter slotted hair curling roller of the present invention having two elongated crescent-shaped cylinder portions 12 and 14. First cylinder portion 12 has a greater diameter than the second cylinder portion 14, and these two portions are secured along parallel edges 16 and 18. Preferably, these roller or cylinder portions are made from plastic material which can be readily bonded along the edges utilizing an adhesive, or by heat or ultrasonic welding, where the cylinder portions are formed independently and must be joined. Of course, instead, the roller may be molded in a single shot or otherwise formed to achieve a unitary structure initially, without having to weld or otherwise secure the two cylinder portions along their common edges.

The edges 16 and 18 which are common to both of the cylinder portions are substantially parallel whereby an elongated slot 20 is formed by the smaller cylinder portion 14 which is positioned within or inwardly of the larger cylinder portion 12. Slot 20 extends the entire length of both cylinder portions, and accordingly, the entire length of the large diameter roller. This feature is important in allowing the slot to be spread somewhat when a smaller roller is snapped therein. In addition, cylinder portion 14 forms a bottom surface for slot 20 whereby the slot is formed and defined by the surface of the small cylinder portion. Without such a definite slot, a smaller roller inserted between edges 16 and 18 would simply fall into the interior of the larger roller. Further, in the preferred embodiment shown, cylinder portion 14 is substantially the same length as cylinder portion 12. However, the smaller cylinder portion need not extend the entire length of the larger cylinder portion provided that slot integrity and smaller roller support is not substantially reduced. As is noted from the drawings, both of the cylinder portions are preferably hollow to achieve a relatively lightweight structure. Moreover, the presence of holes or apertures 15 through both of the cylinder portions further reduces weight as is commonly used in curlers or rollers. Alternatively, a mesh structure may be used to even further reduce the amount of material of composition present in the cylinder portions for additional weight reduction. Thus, the specific structure of the cylinder wall is not critical so long as hair can be easily rolled thereon.

Figure 3:
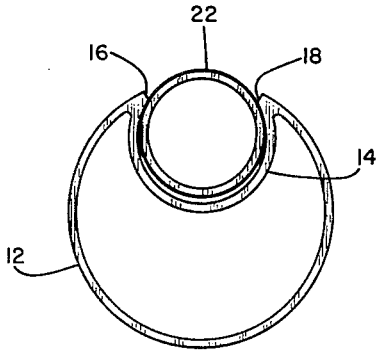
FIG. 3 is an end view showing the roller of FIG. 1 and having a smaller diameter roller removably secured therein.

It will be observed especially in FIGS. 2 and 3 that both cylinder portions have a cross-section which is greater than semi-circular. Accordingly, straight and substantially parallel edges 16 and 18 are not opposed across the diameter of cylinder portion 14. Thus, the opposing edges 16 and 18 form an opening to slot 20 therebetween which is smaller than the diameter across cylinder portion 14. The purpose for such a feature is to provide for a positive gripping and retaining of smaller diameter roller 22 as shown in FIG. 3 which is used in combination with the slotted roller illustrated in FIGS. 1 and 2.

Referring to FIG. 3, the larger diameter slotted roller of the invention is used in combination with smaller diameter roller 22 which is removably secured in elongated slot 20. The slotted roller is preferably made of a plastic material which, although rigid, is also flexible and has a memory, so that smaller roller 22 can be readily pressed and snapped into slot 20. Thus, in order to properly secure roller 22 in the slot, the smaller roller should have a diameter greater than the distance between parallel edges 16 and 18. With such dimensional features of the components, the slot of the larger roller will be spread open and urged temporarily out of its normal rest or unsprung condition as roller 22 is pressed through the opening between parallel edges 16 and 18. These edges will then be urged against or abut the sides of roller 22 once its greatest width or diameter passes through the plane extending between the parallel edges.

In order for the smaller roller 22 to be positively snapped in and retained within slot 20 of the larger, slotted roller, the dimensions of second cylinder portion 14 must be such that edges 16 and 18 will extend beyond the widest portion or diameter of roller 22 and when it is at a rest position and fully seated within slot 20. Thus, the diameter of cylinder portion 14 and roller 22 are equal or roller 22 has a smaller diameter. More preferably, and for most advantageous use of the device, roller 22 will have a smaller diameter than cylinder portion 14 since roller 22 must be snapped within slot 20 after hair has been wrapped around the roller which further increases the diameter of the body to be fitted within slot 20. On the other hand, should the diameter of roller 22 be greater than the diameter of cylinder portion 14, although edges 16 and 18 may extend beyond the widest dimension or diameter of roller 22, once it is fitted within slot 20, the slot would be so greatly spread out and the crescent-shaped cylinder portions may be so severely displaced or distorted that early fatigue or failure, including cracking or splitting of the slotted roller body may occur. Moreover, with such a device the expanded slot surface will be tightly forced and pressed against surface of smaller roller 22, so that there is no significant air space between them. Yet some air space between the smaller roller and slot surface is very important in drying wet hair rolled on the smaller roller and placed in the larger roller slot. Without adequate air space, air circulation around the hair between the slot and roller surfaces is prevented, resulting in greatly increased drying times. However, according to the present invention, with roller 22 having a smaller diameter than the diameter of the slot in cylinder portion 14, adequate air space therebetween for suitably drying wet hair rolled on the small roller is provided.

Figure 4:
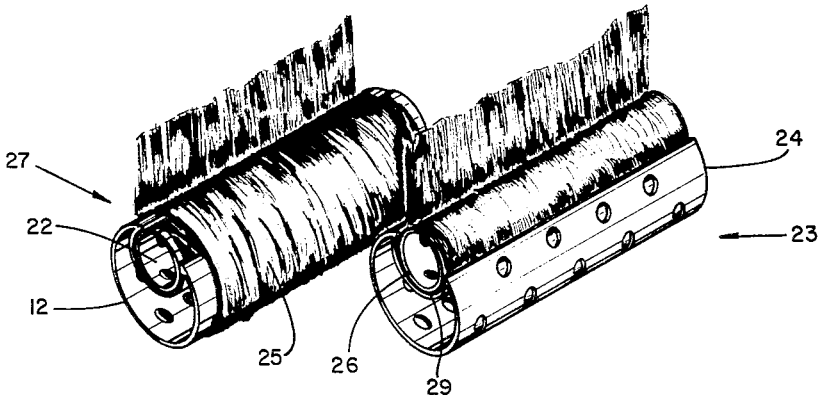
FIG. 4 is a perspective view illustrating the method of curling the hair using the device of the invention.

In FIG. 4, there is illustrated the device of the invention showing its use in curling hair. Curler or roller assembly 23 illustrates the first step in curling the hair utilizing the device of the invention. The ends of strands of hair away from the user's scalp are wrapped or rolled on roller 26, which corresponds to small roller 22 in FIG. 3. This roller and hair are then snapped in placed in the slot formed by crescent-shaped cylinder portion 29, which corresponds to slot 20 in FIG. 2. Once that portion of the hair has been rolled on the smaller roller, and inserted in the slot in the larger, slotted roller 24, further rolling on the large diameter member is accomplished. This is shown in roller assembly 27 whereby hair 25, after having been rolled about smaller roller 22 and secured in slotted roller 12, is then further rolled around that larger diameter member. In other words, once the smaller diameter roller has been secured in the slotted member, rolling of the hair is then simply continued around the larger diameter slotted member to achieve the structure shown in assembly 27. The extent at which the hair is additionally rolled on either of the smaller or larger roller members will depend on the style of hair desired. Once hair 25 is rolled on slotted roller 12 to the desired extent, the roller assembly may be secured on the hair with a bobby pin.

Figure 5:
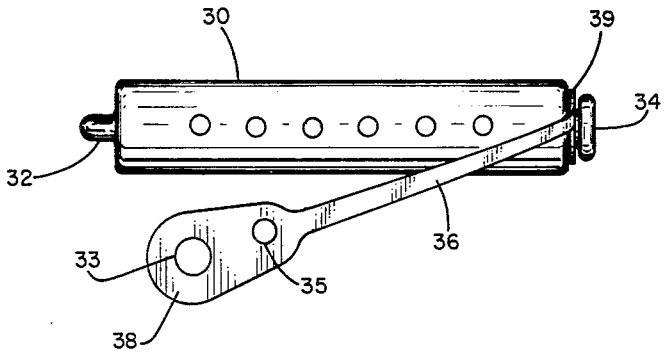
FIG. 5 illustrates another embodiment of a smaller roller to be used in combination with the slotted roller shown in FIG. 1.
Figure 6:
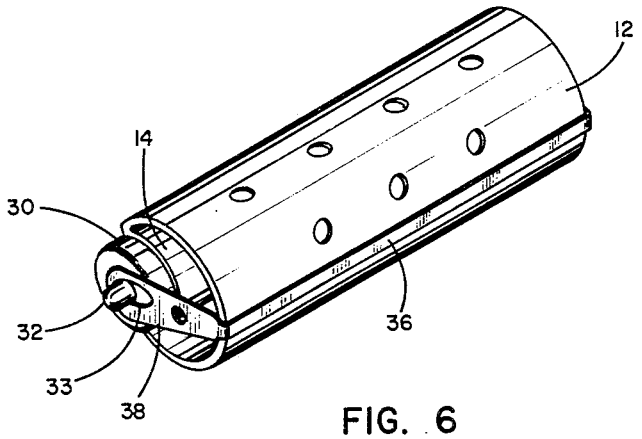
FIG. 6 shows the smaller roller of FIG. 5 secured in a larger roller of FIG. 1.

An alternative embodiment of a smaller roller to be removably secured in the larger cresent-shaped roller slot is illustrated in FIGS. 5 and 6. Such a roller 30 incorporates an elastic band 36, secured at one end of the roller. Conveniently, this is accomplished by incorporating an opening or hole in an enlarged end 39 of the elastic band 36, which hole is placed over button 34 secured at one end of roller 30. At the opposite roller end is a projection or protrubance 32 for securing the other end of elastic band 36. The elastic band preferably has an enlarged end 38 in which are located one or more holes or openings. In the example shown, two openings 33 and 35 are used, either one of which is placed over the projection 32 for securing the elastic band 36. The use of a plurality of such openings allows for the band to be more tightly secured, depending on its elasticity and length, as well as the amount of hair which has been wrapped around the roller assembly.

The use of the small roller embodiment of FIG. 5 is illustrated in FIG. 6, in which roller 30 has been inserted in the slot formed by crescent-shaped cylinder portion 14, and elastic band 36 is secured around larger cylinder portion 12 with projection 32 extending through opening 33 of the band. Thus, in use, with hair rolled about both rollers 30 and 12, the roller assembly is secured by use of the elastic band, theyby obviating the necessity of additional pinning of the assembly in the hair.

In removing the roller assembly of the invention from the hair, after the styling or setting composition has dried sufficiently, the pins are removed or the elastic band is disconnected at the end 38 in the example as shown in FIG. 6, the hair is unrolled from the larger roller portion, the smaller roller is removed from the slot in crescent-shaped cylinder portion 14 and the hair is simply unrolled from the smaller roller.

Figure 7:
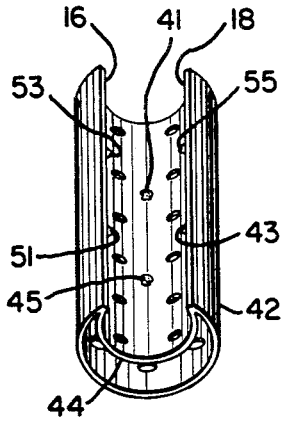
FIG. 7 illustrates a larger roller incorporating nipples along the slot.
Figure 10:
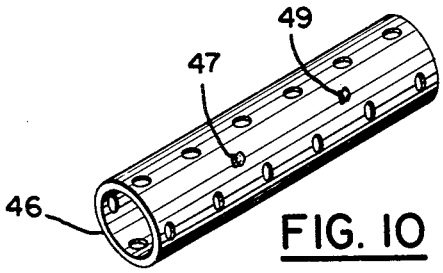
FIG. 10 illustrates a smaller roller having a plurality of nipples therealong.
Figure 11:
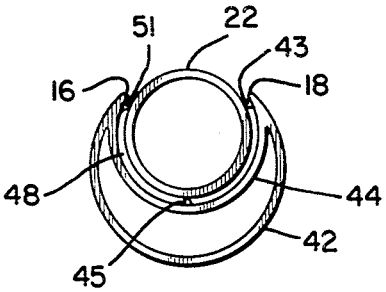
FIG. 11 shows a smaller roller secured in a larger roller of FIG. 7 to illustrate an improved embodiment.

A further improvement in the roller assembly of the invention is illustrated in FIGS. 7–11. In FIG. 7 there is shown a larger diameter slotted roller 42 in which the second cylinder portion 44 is provided with a plurality of protruberances, pins, or nipples 41 and 45 extending outwardly from the surface as is shown. At least two of these nipples are necessary, and they are preferably spaced along the outwardly exposed second cylinder portion surface and extend into the slot, to give a balanced contact with a smaller diameter roller placed in the slot when the assembly is used for curling hair. Although only two of the nipples are shown extending along the bottom of the slot defined by the second cylinder portion 44, a larger number of such nipples may be formed along the slot interior on the cylinder portion surface as desired. Especially prefered are two or more nipples along each edge 16 and 18 of the larger roller as shown in FIGS. 7 and 11. Thus, nipples 51 and 53 are located along edge 16 and nipples 43 and 55 on edge 18 of larger roller 42.

The purpose for the nipples extending into the area of the slot as illustrated in FIG. 7 is to provide and to maintain a spaced relationship between the cylindrical portion surface and a smaller diameter roller placed in the slot. The need for such a separation is to maintain sufficient space between these members so that wet hair, when wrapped around the smaller diameter roller and placed in the slot, can be more easily dried. It will be appreciated that increased drying efficiency is achieved by air passing around the hair. When insufficient space is provided, such as where the hair wrapped around the smaller roller is tightly pressed between the smaller roller and second cylinder portion surfaces, drying time is greatly increased, because of the lack of space between the two members of the assembly to provide for adequate air movement therein for hair drying. This problem is eliminated by incorporating the proturberances or nipples extending outwardly into the slot thereby maintaining adequate separation of the second cylinder portion and smaller diameter roller surfaces. The assembled device incorporating this improvement is illustrated in FIG. 11, in which smaller diameter roller 22 is inserted into the slot provided by second cylinder portion 44 of larger diameter roller 42. The assembly is viewed from one end whereby nipples 43, 45 and 51 of the larger diameter slotted roller 42 shown in FIG. 7 are visible, and contracting the smaller diameter roller thereby maintaining a space 48 between the roller and cylinder portion surfaces for the purpose discussed herein. The preferred nipples extending inwardly from the two opposing edges 16 and 18 are especially helpful in maintaining a space between the roller surfaces for the flow of air to assist in hair drying. Again, any number of such proturberances or nipples may be used by being formed on the cylinder portion surface, and spaced as desired to maintain adequate separation of the assembly components.

Figure 8:
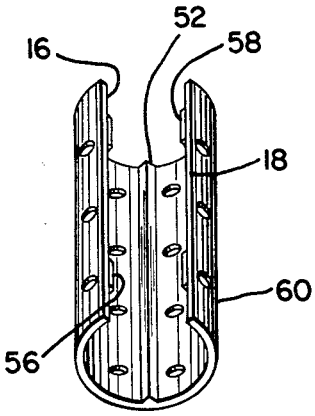
FIGS. 8 and 9 shows a portion of a larger roller incorporating ribs along the slot.
Figure 9:
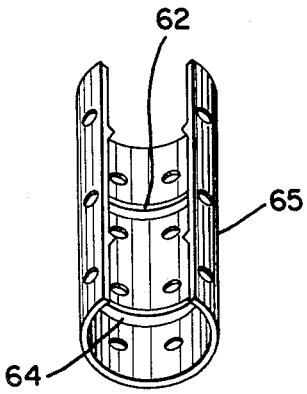

In FIG. 8 another alternative embodiment utilizes ribs along the slot rather than nipples. Accordingly, the second cylinder portion 60 of a larger roller incorporates rib 52 along the bottom of the slot, while rib segments 56 and 58 extend inwardly at the upper opposing edges 16 and 18 of the slot. Such ribs will yield the same advantage of separating the small roller and slot surfaces to allow the passage of air for faster hair drying, as previously explained. Any desired number of such ribs may be used, and their length and shape can be varied, as desired. By way of further example, FIG. 9 illustrates an alternative second cylinder portion 65 of a larger roller having ribs 62 and 64 extending circumferentially along the slot interior, normal to the elongated slot axis. Although each rib is shown as continuous between the slot edges, they may be segmented, thereby providing additional means for air passage.

Alternative to forming the nipples or ribs along the slot in the second cylinder portion surface of the large diameter slotted roller, as previously described, the nipples may be formed on the outer surface of the smaller diameter roller. This embodiment is illustrated in FIG. 10, where nipples 47 and 49 extend outwardly from smaller diameter roller 46. It will be understood that where these protruberances or nipples are formed on the smaller diameter roller for maintaining the spaced relationship between it and the interior slot surface of the large diameter roller, such nipples should be placed around the roller at the different positions so as to insure that some nipples will be in contact with the interior slot surface regardless of small roller disposition therein. Thus, more than two of such nipples will be necessary for achieving the desired purpose. Moreover, the nipples will have to exend radially from the roller surface sufficiently to extend beyond hair rolled thereon, to achieve the spacial relationship between the roller and slot surfaces. Regardless of which embodiment is used, it is convenient to form the nipples or ribs in the larger or smaller rollers at the time that the roller assembly is manufactured, preferably accomplished in the molding so that they are integral with the assembly component on which they are secured.

The various sizes of the roller assembly may be varied as desired. Accordingly, cylinder portion 12 may be of any roller size, normally up to about $1\frac{3}{4}''$, and as small as about $\frac{3}{4}''$. The size of the smaller cylinder portion 14 may also be widely varied between about $\frac{1}{2}''$ and $1''$, in any of the larger size rollers. Thus, a $\frac{1}{2}''$ smaller cylinder portion may be combined with a $1\frac{3}{4}''$ larger cylinder portion, or a $1''$ smaller cylinder portion may be used in combination with a $1\frac{1}{4}''$ larger cylinder portion. Again, the sizes are not critical, so long as the relationship of the smaller roller with the slot in the larger roller member, as described herein, is observed. Although the embodiments shown and described have primarily used thin-walled, hair setting, plastic rollers, the invention herein may be applied to permanent wave rods as well. Such rods may be substantially solid or thick or thin-walled, some of which are heated prior to wrapping hair thereon. These as well as other embodiments within the purview of the invention will be evident to those skilled in the art.

I claim:

1. An assembly for use in curling hair comprising:

a larger slotted roller having two elongated crescent-shaped cylinder portions, each having a channel extending substantially along their respective lengths between two parallel edges, and along which edges the portions are joined, said first cylinder portion having a greater diameter than said second cylinder portion, said second portion being secured interiorly of said first portion and having an inner surface defining an elongated slot extending along the length of said slotted roller, and a plurality of ribs or nipples extending radially into said slot from said inner surface, and a smaller cylindrical roller having an outer diameter less than the inner diameter of said second cylinder portion, and secured in said slot of said second cylinder portion, said ribs or nipples being located along said inner surface, whereby respective adjacent surfaces of said smaller roller and said inner surface of said larger slotted roller are uniformly spaced apart by said ribs or nipples, whereby hair rolled on said smaller cylindrical roller is spaced apart from said inner surface by said ribs or nipples and whereby drying time of said hair is substantially reduced.

2. The assembly of claim 1 wherein said ribs extend normal to the elongated slot axis.

3. The assembly of claim 1 wherein said ribs extend lengthwise along the elongated slot axis.

4. The assembly of claims 3 or 2 wherein said ribs are segmented.

* * * * *